137-13 SR

C6306 XR 4,356,078

United States Patent [19]

Heavin et al.

[11] 4,356,078

[45] Oct. 26, 1982

[54] PROCESS FOR BLENDING COAL WITH WATER IMMISCIBLE LIQUID

[75] Inventors: Leonard J. Heavin, Olympia; Edward E. King, Gig Harbor; Dennis L. Milliron, Lacey, all of Wash.

[73] Assignee: The Pittsburg & Midway Coal Mining Co., Englewood, Colo.

[21] Appl. No.: 184,762

[22] Filed: Sep. 8, 1980

[51] Int. Cl.[3] ..... C10G 1/00

[52] U.S. Cl. ..... 208/8 LE; 406/46; 406/47; 406/197

[58] Field of Search ..... 208/8 LE; 406/46, 47, 406/197

[56] References Cited

U.S. PATENT DOCUMENTS

| | | | |
|---|---|---|---|
| 66,511 | 7/1867 | McKenzie | 201/23 |
| 915,260 | 3/1909 | Wilkinson | 241/21 X |
| 1,382,457 | 6/1921 | Bates | 241/51 |
| 1,390,228 | 9/1921 | Bates | 241/21 X |
| 1,390,232 | 9/1921 | Bates | 241/51 |
| 1,904,586 | 4/1933 | Winkler et al. | 208/8 R |
| 1,961,982 | 6/1934 | Pier et al. | 196/53 |
| 1,984,596 | 12/1934 | Pier et al. | 196/53 |
| 2,162,200 | 5/1939 | Kiesskalt | 44/1 |
| 2,430,085 | 11/1947 | Spencer et al. | 241/17 |
| 2,832,724 | 4/1958 | Doughty et al. | 208/8 |
| 3,152,063 | 10/1964 | Schroeder et al. | 208/10 |
| 3,444,047 | 5/1969 | Wilde | 201/6 |
| 3,505,203 | 4/1970 | Nelson | 208/8 |
| 3,520,794 | 7/1970 | Gatsis | 208/8 |
| 3,644,192 | 2/1972 | Li et al. | 208/8 LE |
| 3,779,893 | 12/1973 | Lear et al. | 423/138 X |
| 3,791,956 | 2/1974 | Gorin et al. | 208/8 LE |
| 3,884,796 | 5/1975 | Hinderliter et al. | 208/8 LE |
| 4,106,996 | 8/1978 | Wenzel et al. | 201/8 |
| 4,150,953 | 4/1979 | Woodmansee | 48/71 |
| 4,159,195 | 6/1979 | Clavenna | 48/197 R |
| 4,189,375 | 2/1980 | Kirby et al. | 208/8 LE |

OTHER PUBLICATIONS

Kirk-Othmer Encyclopedia of Chemical Technology, 2nd Completely Revised Edition, vol. 13.

Chemical Engineering, Dec. 9, 1974, pp. 113-116, "Feeding Coal to Pressurized Systems", Ferretti.

McClain, A. W., "Pet. Formcoke for Foundry y Use", Proceeding, Institute for Briquetting and Agglomeration, vol. 13, pp. 187-193.

"Paste Mixing and Processing", Chem. Eng. Handbook, 4th Ed., McGraw-Hill Book Co., Inc., Sec. 19, pp. 26, 27, 34, 35.

*Primary Examiner*—Delbert E. Gantz
*Assistant Examiner*—William G. Wright
*Attorney, Agent, or Firm*—Roylance, Abrams, Berdo & Farley

T 2012P

[57] ABSTRACT

A continuous process for blending coal with a water immiscible liquid produces a uniform, pumpable slurry. Pulverized raw feed coal and preferably a coal derived, water immiscible liquid are continuously fed to a blending zone (12 and 18) in which coal particles and liquid are intimately admixed and advanced in substantially plug flow to form a first slurry. The first slurry is withdrawn from the blending zone (12 and 18) and fed to a mixing zone (24) where it is mixed with a hot slurry to form the pumpable slurry. A portion of the pumpable slurry is continuously recycled to the blending zone (12 and 18) for mixing with the feed coal.

26 Claims, 1 Drawing Figure x137/13 W plug-flow mixing
multiple mixing zone.

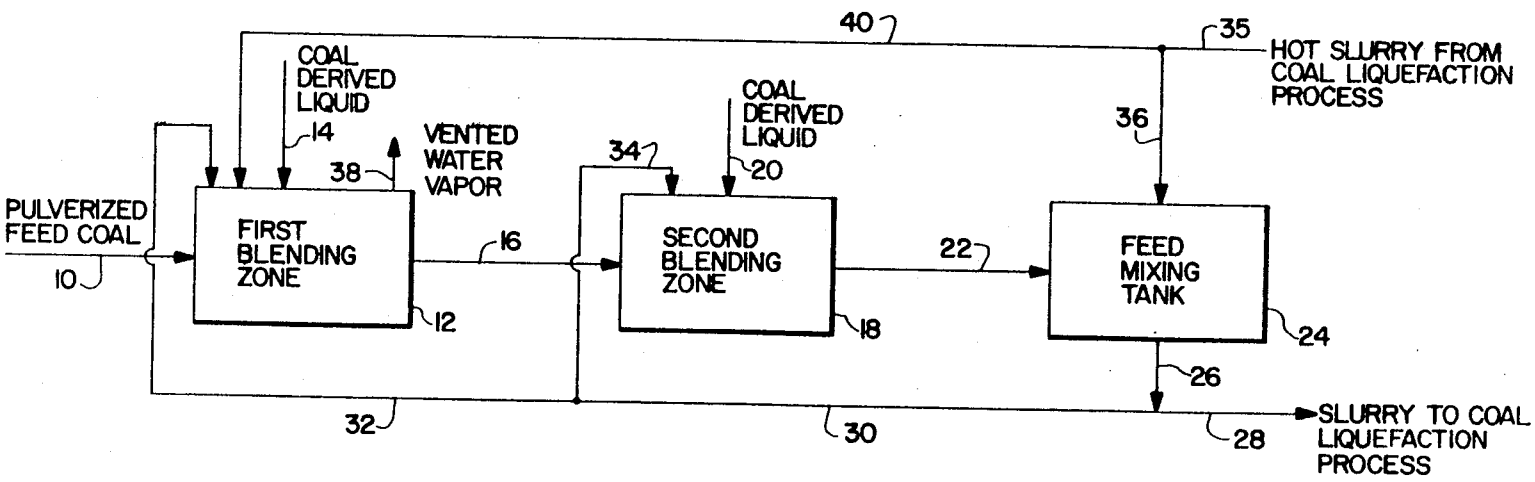
HOT SLURRY FROM COAL LIQUEFACTION PROCESS
SLURRY TO COAL LIQUEFACTION PROCESS
FEED MIXING TANK
SECOND BLENDING ZONE
FIRST BLENDING ZONE
COAL DERIVED LIQUID
COAL DERIVED LIQUID
VENTED WATER VAPOR
PULVERIZED FEED COAL
10
12
14
16
18
20
22
24
26
28
30
32
34
35
36
38
40

PROCESS FOR BLENDING COAL WITH WATER IMMISCIBLE LIQUID

The Government of the United States of America has rights in this invention pursuant to Contracts Nos. DE-AC01-79ET10104 and DE-AC05-78OR03055 awarded by the U.S. Department of Energy to The Pittsburh & Midway Coal Mining Co., a subsidiary of Gulf Oil Corporation.

BACKGROUND OF THE INVENTION

1. Field of the Invention

This invention relates to a process for blending coal with a water immiscible liquid to form a pumpable slurry. More particularly, the present invention relates to the formation of a pumpable slurry of feed coal and a water immiscible liquid derived from coal at elevated temperatures by intimately admixing coal and liquid in a blending zone in which the resulting slurry is advanced in substantially plug flow and in which a portion of the pumpable slurry output of the system is recycled to the blending zone.

2. Description of the Prior Art

The feed to coal liquefaction systems is pulverized raw coal which is admixed with a solvent which is a coal derived, water immiscible liquid to produce a slurry which must be of uniform consistency and pumpable so that it can be fed to a tubular preheater zone wherein each increment of slurry is heated in a heated coil to initiate reactions necessary to convert the coal to deashed hydrocarbonaceous liquid and solid fuel. The abrasive nature of the coal solids and the relatively high viscosity of the coal derived hydrocarbonaceous liquids and molten solids make mixing difficult and rapidly induce wear and damage to the mixing apparatus. Difficult mixing has required excessive expenditures of energy. Wear and damage to the apparatus can necessitate frequent interruptions to the process and result in high maintenance costs.

Several conventional systems have been employed for forming slurries of coal with a coal derived, water immiscible liquid. One system involves the use of a mixing tank with a mechanical agitator for forming the slurry. In such a system, pulverized raw coal added to the liquid or slurry tends to float on the top surface of such liquid or slurry, especially if the liquid is thick and viscous and has a relatively high density, in a range of about 60 pounds per cubic foot (960 kilograms per cubic meter) or more, and the floating coal forms lumps of solid particles wetted only on the outside by the liquid. The lumps that do not break up settle to the bottom of the mixing tank and eventually will plug the outlet lines and the pumping system through which the slurry must pass. Additionally, the coal swells and forms a gel when contacted with a hot, coal derived liquid, and the viscous gel formed by the swelling of the coal resists mixing and is very difficult to pump. The mixing tank-mechanical agitator system is also disadvantageous in that the energy consumption is very high.

Another conventional system involves the use of an eductor in which pulverized raw coal is drawn from an outlet at the bottom of a hopper by a liquid or slurry moving adjacent the hopper outlet at a high velocity. The high velocity movement of the liquid or slurry creates a low pressure zone to draw pulverized raw coal from the hopper. The eductor system is disadvantageous in that the pulverized raw coal in the hopper may bridge the outlet opening stopping the flow of coal. Additionally, the energy consumption required to pump the liquid or slurry at a high velocity past the hopper outlet is even higher than that utilized in the mixing tank-mechanical agitator system. An eductor system is disclosed in U.S. Pat. No. 3,779,893 to Leas et al. wherein the feed coal is mixed with oil to form a slurry which is fed to an eductor and the resulting slurry is picked up by high velocity oil moving past the outlet of the coal-oil mix tank.

Various blending devices such as pug mills, ball mills, and screw-type mixers have been employed to mix coal with solvent liquids. Generally, such devices cause the wet coal solids to become so tightly compressed that they form agglomerates which will not readily break up in a mixing tank, even if uniformly wetted. The paste output of such devices has to be mixed with additional liquid in order to reach the required solids concentration. Since the agglomerated products of these device are not capable of being readily broken up, a slurry of uniform composition cannot be thereafter readily produced by normal mechanical agitation in a mixing tank.

Thus, conventional mixing systems have not been effective since they have failed to rapidly and uniformly mix the coal with hot, heavy liquid or slurry. Additionally, these systems require high expenditures of energy to operate.

SUMMARY OF THE INVENTION

It has now been discovered that the disadvantages associated with the use of conventional systems for mixing coal with a water immiscible liquid to form a pumpable slurry can be eliminated by the present invention which comprises a continuous process for blending coal with a water immiscible liquid, preferably derived from coal, to form a pumpable slurry wherein pulverized raw feed coal and water immiscible liquid are continuously fed to a blending zone in which coal and liquid, at least some of which is supplied in a slurry, are intimately admixed and advanced in a substantially plug flow to form a first slurry. The expression "pumpable slurry" as used in this application means a slurry of generally uniform consistency and capable of being pumped through a heated coil of the type utilized in coal liquefaction systems. The first slurry is then withdrawn from the blending zone and passed to a feed mixing zone where it is mixed with a hot second slurry (e.g., at a temperature of between 400° F. (204° C.) and 800° F. (427° C.) from a coal liquefaction process to form a pumpable slurry. A portion of the pumpable slurry is continuously recycled to the blending zone as a third slurry to provide at least a portion of the water immiscible liquid.

In the process of the present invention, the recycling of a portion of the pumpable slurry output of the system as a third slurry ensures that the temperature gradient and the concentration gradient of solid particles in the slurry throughout the system will be relatively small. The relatively small temperature and concentration gradient minimize the formation of lumps or aggregates, thereby increasing the uniformity of the pumpable slurry output of the system and enhancing the operability of the system. These advantages are further enhanced by making the ratio of the third slurry to feed coal passing through the blending zone to be relatively high, for example, at least about 3:1.

The use of a blender having rotating blades, such as a pug mill, intimately contacts and wets the coal particles uniformly with the water immiscible liquid and advances the slurry through the blending zone in substantially plug flow. The mechanical action of the blades of the blender prevents the formation of lumps of dry particles in a viscous, gel-like shell of overly wetted particles. Additionally, such blenders are capable of operating effectively at the normal slurry temperatures (usually about 200°-500° F., 93°-260° C.) without undue wear, frequent breakdowns and high energy consumption.

The system of the present invention is further enhanced by providing two blending zones or stages connected in series, and the third slurry and liquid can be separately added to each of these stages. Slurry recycled from a coal liquefaction system can be mixed with the first slurry from the second blending zone in the mixing tank to enhance the uniformity of the slurry and to maintain the slurry at a relatively high temperature. By adding a relatively hot slurry (having a temperature in the range of between about 250° and about 600° F., 121° and 315° C.) to the blending zone, any moisture in the feed coal is vaporized by the circulating slurry and then vented. Additionally, slurry recycled from a coal liquefaction system can be mixed with the slurry in the first blending zone to vaporize moisture in the feed coal.

Other advantages and salient features of the present invention will become apparent from the following detailed description, which taken in conjunction with the annexed drawing, discloses a preferred embodiment at the present invention.

The "water immiscible liquid" of the present invention is preferably derived from a coal liquefaction process. However, any suitable water immiscible liquid can be employed in the process of this invention, such as liquids derived from petroleum.

The expression "plug flow" as used in this application describes the movement of a slurry through a blender, such as a pug mill or twin-screw feeder, in which there is substantially no back mixing, although there can be sideways movement, and there is a generally uniform net movement of the profile in a substantially forward direction.

BRIEF DESCRIPTION OF THE DRAWING

The single FIGURE is a schematic illustration of a system for blending coal with a coal derived, water immiscible liquid to form a pumpable slurry in accordance with the present invention.

DETAILED DESCRIPTION OF THE PREFERRED EMBODIMENT OF THE INVENTION

Referring to the single FIGURE, raw pulverized feed coal is fed along line 10 by a suitable conventional conveyor to a first blending zone or stage 12. The feed coal may or may not be predried, or it may be partially predried. Any moisture in the feed coal can be removed in first blending zone 12. Coal derived, water immiscible liquid, preferably that contained in the slurry in line 32, is added to first blending zone 12. Additional water immiscible liquid may be added through line 14.

The output of first blending zone 12 is conveyed in line 16 to a second blending zone or stage 18. Additional coal derived, water immiscible liquid is supplied as part of the slurry in line 34 to second blending zone 18 for mixing with the slurry output 16 of first blending zone 12. Additional water immiscible liquid may be supplied to zone 18 by means of line 20.

The output from second blending zone 18 is conveyed in line 22 to a feed mixing tank 24. Feed mixing tank 24 serves as a mixing vessel and a reservoir for feed pumps to pump the pumpable slurry output of the system and to maintain the uniformity and temperature of the slurry entering the pumping system. Hot slurry is recycled from the coal liquefaction process as a second slurry and is fed through line 35 to line 36 into feed mixing tank 24 for mixing with the output of second blending zone 18 conveyed through line 22. This second slurry has a temperature of at least about 400° F. (204° C.) and may have a temperature as high as about 800° F. (427° C.). Preferably, the second slurry has a temperature in the range between about 500° and about 700° F. (260°-371° C.). The addition of hot slurry recycled from a coal liquefaction process also serves to supply the heat required to maintain the appropriate temperature of each slurry in the system, and thereby improves the thermal efficiency of the overall liquefaction process.

Output line 26 of feed mixing tank 24 is divided into two separate lines 28 and 30. Line 28 conveys the pumpable slurry output of the system to a coal liquefaction process. Line 30 is further divided into lines 32 and 34 for continuously recycling slurry into first and second blending zones 12 and 18, respectively, to supply at least a portion of water immiscible liquid. The recycled portion of the pumpable slurry output of feed mixing tank 24 is mixed with the feed coal in blending zones 12 and 18 as a third slurry to minimize the temperature gradient and the concentration gradient throughout the system.

The third slurry added to first blending zone 12 through line 32 maintains the temperature in first blending zone 12 in the range between about 200° F. (93° C.) and about 450° F. (232° C.), and preferably between about 250° (121° C.) and about 400° F. (204° C.). This temperature in first blending zone 12 is sufficiently high to vaporize most of the moisture in the feed coal. The vaporized moisture exits through a suitable vent 38 and is passed through a condenser. Vaporizing and venting of moisture is a convenience with predried or partially predried coal. For coal which has not been predried, vaporizing and venting of moisture in first blending zone 12 is essential to prevent foaming in the slurry which would adversely affect downstream pumping and coal liquefaction processing. Hot slurry from line 35 may be passed through line 40 to first blending zone 12 to enhance vaporization of the moisture. For example, in the case of high moisture coal, the present invention provides a practical, economical and efficient system for removing moisture from the feed coal. Water vapor would adversely affect the downstream coal conversion process by causing cavitation of downstream pumping apparatus and by reducing the hydrogen partial pressure in the system, necessitating increased hydrogen compression costs to compensate for the hydrogen partial pressure loss in the system.

Coal derived, water immiscible liquid may be added to first blending 12 through lines 14 and 32 at a rate in the range between about 0.5 and about 5.0 pounds of liquid per pound of feed coal on a moisture free basis added through line 10. However, it is preferred to supply all of the water immiscible liquid via recycled slurry to line 32.

The third slurry is added to blending zones 12 and 18 at a weight ratio on a moisture free basis of slurry to feed coal in a range between about 3:1 and about 30:1. Preferably, the weight ratio of the third slurry to feed coal is in the range between about 5:1 and about 15:1. The weight percentage of the total third slurry flowing in line 30 which is added to first blending zone 12 through line 32 is in the range between about 10 and about 50 weight percent, and preferably is in the range between about 20 and about 40 weight percent. The remaining portion of the third slurry from line 30 passes through line 34 to second blending zone 18. Alternatively, the total slurry in line 30 may be added to either blending zone 12 or blending zone 18 if desired.

The pulverized raw feed coal from line 10, the limited amount of coal derived liquid from line 14, if any, and the third slurry from line 32 are blended in first blending zone 12 to form a semisolid paste effluent. The temperature of the slurry in first blending zone 12 is in the range between about 200° and about 450° F. (93° and 232° C.), and is preferably in the range between about 250° and about 400° F. (121° and 204° C.). The total residence time of the slurry in first blending zone 12 is in the range between about one and about ten minutes. First blending zone 12 should be large enough to thoroughly and uniformly wet all of the particles in forming its semisolid paste effluent. The mechanical action of the blending device conveys the semisolid paste effluent of first blending zone 12 through line 16 and into second blending zone 18. In second blending zone 18, additional coal derived, water immiscible liquid may be added through line 20 and slurry is added through line 34. The total rate for the two streams is in the range between about 2.0 and about 25 pounds of liquid per pound of feed coal on a moisture free basis.

The semisolid paste effluent of first blending zone 12, any additional coal derived liquid from line 20, and the third slurry from line 34 are blended in second blending zone 18 to produce a first slurry of uniform concentration. The temperature of the slurry in second blending zone 18 is in the range between about 300° and about 500° F. (149° and 260° C.), and is preferably in the range between about 350° and about 450° F. (177° and 232° C.). The uniform first slurry output of second blending zone 18 is conveyed by the mechanical action of the blender through line 22 to feed mixing tank 24.

Preferably, each blending zone 12 and 18 can comprise, for example, a pug mill. Thus, blending zones 12 and 18 can be two pug mills connected in series. Alternatively, zones 12 and 18 can comprise a single pug mill separated into zones 12 and 18 by a baffle provided above the pug mill blades. Multiple screw feeders may be employed in place of the pug mill to constitute blending zones 12 and 18 in a similar manner. Coal and coal derived, water immiscible liquids are intimately admixed and advanced in substantially plug flow through blending zones 12 and 18.

In feed mixing tank 24, the hot slurry recycled from the coal liquefaction process from line 36 is mixed with the intermediate stage slurry from line 22 by a conventional mechanical agitator to produce the pumpable slurry output. The temperature of the slurry in mixing tank 24 is in the range between about 250° and about 600° F. (121° and 316° C.), and is preferably in the range between about 350° and about 550° F. (177° and 260° C.).

By recycling a portion of the pumpable slurry output of this system, the concentration gradient of solid particles in the slurry and the temperature gradient throughout the system are relatively small. These relatively small gradients minimize the formation of lumps or agglomerates of coal particles, and thereby enhance the operation of this system and the pumpable slurry produced. The addition of limited quantities of coal derived, water immiscible liquid in blending zone 12, in particular, and in zone 18 together with the mechanical action of the blades of the blenders, assists in producing a more uniform first slurry by avoiding the formation of lumps of dry coal particles in a viscous gel-like shell of overly wetted coal particles. This more uniform first slurry is more readily combined with the hot recycled slurry from the coal liquefaction process in feed mixing tank 24.

The recycle of hot slurry from line 36 and from mixing tank 24 improves significantly the thermal efficiency and maintains the proper viscosity of the slurries throughout the entire system. The improved thermal efficiency makes the overall liquefaction process viable and economic.

Pug mills are particularly advantageous in this system due to their ability to operate efficiently at relatively high temperature ranges. High temperature ranges accelerate the swelling of the coal in the presence of the coal derived, water immiscible liquid, thereby tending to form a sticky, viscous gel with the feed coal. The gel aggravates the problem of the formation of the lumps of agglomerated coal particles which adversely affect the production of a uniform slurry output. The rotating blades of the pug mill overcome this problem by uniformly wetting the coal particles in a blending action, even when performed with hot liquid such as that of a coal conversion process. The high shearing action of the pug mill provides a uniform blend of solids and liquid. Additionally, the self-cleaning action of the pug mill prevents clogging of the system.

The process of the present invention will now be illustrated by using the arrangement depicted in the drawing.

Raw feed coal is fed to first blending zone 12 at a temperature of 100° F. (38° C.). Concurrently, recycled slurry (44 weight percent solids) in line 32 at a temperature of 450° F. (232° C.) is introduced into blending zone 12 at the rate of 2.5 pounds of slurry per pound of raw feed coal on a MF (moisture free) basis. A semisolid paste effluent comprising 60 weight percent solids is withdrawn from zone 12 by line 16 at a temperature of 350° F. (177° C.) and passed to blending zone 18 at the rate of 3.5 pounds of effluent per pound of MF coal along with recycled slurry (44 weight percent solids) in line 34 at a temperature of 450° F. (232° C.) and at the rate of 7.5 pounds of slurry per pound of MF coal. Slurry (49.1 weight percent solids) from blending zone 18 is passed in line 22 to feed mixing tank 24 at a temperature of 418° F. (214° C.) and at the rate of 11 pounds of slurry per pound of MF coal and is mixed with a recycle slurry produced in a coal liquefaction process comprising 20 weight percent solids, at a temperature of 600° F. (316° C.) and at the rate of 2.33 pounds of slurry per pound of MF coal. For example, such hot recycle slurry may be stream 58 in FIG. 2 of U.S. Pat. No. 4,159,238 to Bruce K. Schmid, which patent is hereby incorporated by reference.

A slurry comprising 44 weight percent solids at a temperature of 450° F. (232° C.) is withdrawn from zone 24 at the rate of 3.33 pounds per pound of MF coal in line 28 for passage to a coal liquefaction process. This slurry is highly pumpable and of uniform consistency.

Although the invention has been described in considerable detail with particular reference to a certain prefered embodiment thereof, variations and modifications can be effected within the spirit and scope of the invention as defined in the appended claims.

What is claimed is:

1. A continuous process for blending pulverized coal with a water immiscible liquid to form a pumpable slurry, which comprises continuously feeding pulverized raw feed coal and a water immiscible liquid to a blending zone in which coal particles and liquid are intimately admixed and advanced in substantially plug flow such that the resulting slurry passes through said blending zone without substantial backmixing to form a first slurry;

withdrawing said first slurry from said blending zone and passing it to a separate feed mixing zone where said first slurry is mixed with a hot, second slurry to form a pumpable third slurry of generally uniform consistency; and withdrawing said pumpable third slurry from said feed mixing zone and continuously recycling a first portion of said pumpable third slurry directly to said blending zone to provide at least a portion of the said water immiscible liquid and passing a second portion of said pumpable third slurry to a preheating zone of a coal liquefaction process.

2. The process of claim 1 wherein said water immiscible liquid is derived from a coal liquefaction process.

3. The process of claim 1 wherein the weight ratio of said third slurry to said raw feed coal is at least about 3 to 1.

4. The process of claim 3 wherein said weight ratio of said third slurry to said raw feed coal is in the range between about 5 to 1 and about 15 to 1.

5. The process of claim 1 wherein said blending zone comprises separate first and second blending stages connected in series.

6. The process of claim 5 wherein said third slurry is recycled to at least one of said first and second blending stages.

7. The process of claim 6 wherein from about 10 to about 50 weight percent of said third slurry is recycled to said first blending stage and the remainder of said third slurry is recycled to said second blending stage.

8. The process of claim 5 wherein said water immiscible liquid is added to said first blending stage at a rate in the range of about 0.5 to about 5.0 pounds per pound of feed coal on a moisture free basis.

9. The process of claim 5 wherein said water immiscible liquid is added to said second blending stage at a rate in the range from about 2 to about 25 pounds per pound of feed coal on a moisture free basis.

10. The process of claim 5 wherein the effluent from said first blending stage is a semisolid paste.

11. The process of claim 1 wherein said second slurry is obtained from a coal liquefaction process and is at a temperature of at least about 400° F. when added to said feed mixing zone.

12. The process of claim 11 wherein the temperature of said second slurry is in the range of between about 500° and about 700° F.

13. The process of claim 1 wherein said feed mixing zone is operated at a temperature in the range of about 250° to about 600° F.

14. The process of claim 1 wherein moisture in said raw feed coal is vaporized by the heat content of said third slurry added in said blending zone.

15. The process of claim 1 wherein slurry from a coal liquefaction process comprising a fourth slurry at a temperature in the range of between about 500° and about 700° F. is added to said blending zone.

16. The process of claim 1 wherein said blending zone comprises at least one pug mill zone.

17. The process of claim 16 wherein said blending zone comprises at least two pug mill zones.

18. The process of claim 1 wherein said blending zone comprises at least one multiple-screw feeder zone.

19. The process of claim 1 wherein slurry from said coal liquefaction process is recycled as said second slurry to said feed mixing zone.

20. The process of claim 1 wherein slurry from said coal liquefaction process is recycled as a fourth slurry to said blending zone.

21. The process of claim 1 wherein hot slurry from a coal liquefaction process is recycled to said blending zone.

22. The process of claim 1 wherein said preheating zone comprises a heated coil.

23. A continuous process for blending pulverized coal with a water immiscible liquid to form a pumpable slurry, which comprises continuously feeding pulverized raw feed coal and a water immiscible liquid to a blending zone in which coal particles and liquid are intimately admixed and advanced in substantially plug flow such that the resulting slurry passes through said blending zone without substantial backmixing to form a first slurry;

recycling hot slurry from a coal liquefaction process to said blending zone;

withdrawing said first slurry from said blending zone and passing it to a separate feed mixing zone where said first slurry is further mixed to form a pumpable third slurry of uniform consistency; and withdrawing said pumpable third slurry from said feed mixing zone and continuously recycling a first portion of said pumpable slurry directly to said blending zone to provide at least a portion of the said water immiscible liquid and passing a second portion of said pumpable third slurry to a preheating zone of a coal liquefaction process.

24. A continuous process for blending pulverized coal with a water immiscible liquid to form a pumpable slurry, which comprises, continuously feeding pulverized raw feed coal and a water immiscible liquid to a blending zone comprising at least one pug mill zone in which coal particles and liquid are intimately admixed and advanced in substantially plug flow such that the resulting slurry passes through said blending zone without substantial backmixing to form a first slurry;

withdrawing said first slurry from said blending zone and passing it to a separate feed mixing zone where said first slurry is mixed with a hot, second slurry to form a pumpable third slurry; and withdrawing said pumpable third slurry from said feed mixing zone and continuously recycling a portion of said pumpable third slurry directly to said blending zone to provide at least a portion of the said water immiscible liquid.

25. The process of claim 24 wherein said blending zone comprises at least two pug mill zones.

26. A continuous process for blending pulverized coal with a water immiscible liquid to form a pumpable slurry, which comprises, continuously feeding pulverized raw feed coal and a water immiscible liquid to a blending zone comprising at least one multiple-screw feeder zone in which coal particles and liquid are intimately admixed and advanced in substantially plug flow such that the resulting slurry passes through said blending zone without substantial backmixing to form a first slurry;

withdrawing said first slurry from said blending zone and passing it to a separate feed mixing zone where said first slurry is mixed with a hot, second slurry to form a pumpable third slurry; and withdrawing said pumpable third slurry from said feed mixing zone and continuously recycling a portion of said pumpable third slurry directly to said blending zone to provide at least a portion of the said water immiscible liquid.

* * * * *

UNITED STATES PATENT OFFICE

CERTIFICATE OF CORRECTION

Patent No. 4,356,078 Dated October 16, 1982

Inventor(s) Leonard J. Heavin, Edward E. King and Dennis L. Milliron

It is certified that error appears in the above-identified patent and that said Letters Patent are hereby corrected as shown below:

Col. 2, line 19, "device" should be --devices--;
Col. 4, line 59, "blending 12" should be --blending zone 12--;
Col. 4, line 64, "to" should be --in--;
Col. 5, line 61, "550°F." should be --500°F.--

Signed and Sealed this

Tenth Day of May 1983

[SEAL]

Attest:

GERALD J. MOSSINGHOFF

Attesting Officer

Commissioner of Patents and Trademarks